US005298832A

United States Patent [19]

Jeong et al.

[11] Patent Number: 5,298,832

[45] Date of Patent: Mar. 29, 1994

[54] SHADOW MASK FRAME FOR PREVENTION OF HALATION

[75] Inventors: Byeong G. Jeong; Keun B. Lee, both of Kyunggi, Rep. of Korea

[73] Assignee: Samsung Electron Devices Co., Ltd., Kyunggi, Rep. of Korea

[21] Appl. No.: 426,233

[22] Filed: Oct. 25, 1989

[30] Foreign Application Priority Data

Oct. 25, 1988 [KR] Rep. of Korea ..... 88-13930

[51] Int. Cl.[5] ..... H01J 29/81

[52] U.S. Cl. ..... 313/407; 313/402

[58] Field of Search ..... 313/402, 407

[56] References Cited

U.S. PATENT DOCUMENTS

| | | | |
|---|---|---|---|
| 3,519,869 | 7/1970 | Kuniyoshi | 313/402 |
| 3,588,568 | 6/1971 | Sohn | 313/407 |
| 4,659,959 | 4/1987 | Fonda | 313/407 |
| 4,931,690 | 6/1990 | Kokubu et al. | 313/407 |

FOREIGN PATENT DOCUMENTS

| | | | |
|---|---|---|---|
| 68835 | 4/1986 | Japan | 313/402 |

*Primary Examiner*—Donald J. Yusko
*Assistant Examiner*—Michael Horabik
*Attorney, Agent, or Firm*—Robert E. Bushnell

[57] ABSTRACT

A shadow mask frame for prevention of halation in a color picture tube is characterized in that a bent end portion bent toward the frontal face of the panel is provided around the periphery of an open portion of the frame in a predetermined inclination angle relative to the plane of the frame, the bending being formed toward the panel of the picture tube. The ineffectively overscanned electron beams are positively reflected away toward the opposite side of the luminescent screen, with the result that not only the halation prevention effect becomes superior, but also that there is no difficulty in manufacturing and assembling.

20 Claims, 5 Drawing Sheets

SHADOW MASK FRAME FOR PREVENTION OF HALATION

FIELD OF THE INVENTION

The present invention relates to a shadow mask frame for prevention of halation, and particularly to the structure of a novel shadow mask capable of preventing the halation due to the reflections of the overscanned or excessively deflected electron beams in a shadow mask type color picture tube.

BACKGROUND OF THE INVENTION

As shown in FIG. 1, the ordinary shadow mask type color picture tube is constituted such that a luminescent screen 12 is formed on the inner surface of the face plate of a panel 11, a shadow mask 13 supported by a frame 14 is installed in such a manner as to be separated as much as a certain gap from the luminescent screen 12, and electron beams emitted from an electron gun (not shown) are made to selectively land on the luminescent screen 12 by means of the shadow mask 13 so that the intended image should be formed by visible light emitting from of the luminescent screen 12.

The electron beams emitted by the electron gun are deflected by deflecting means such as deflecting coils and the like, so that the beams should land on the visible region of the luminescent screen 12. However, the so-called over-scanned beams which are produced by departing from the effective region after being excessively deflected are reflected from the side face of the panel or the side end of an opening portion of the frame, resulting in that a twice (i.e., double) luminescence is caused, thereby degrading the image quality through the aggravations of the luminance and purity, and producing the so-called halation phenomenon, in other words "visible electron flooding".

As a measure against this phenomenon, an electron shield 15 made of a thin metal sheet is installed in the space between the side face of the panel 11 and the outer face of the frame 14 as a blocking element against the reflections from the side face of the panel, while one of various kinds of elements are provided against the reflections from the side end of the opening portion of the frame 14.

To describe in a more detail the reflection mechanism of the beams from the side end of the open portion of the frame 14, this frame 14 has usually a thickness of 1 to 2 mm, and therefore, ineffective electron beams of the outermost region of the effective region i.e., the ineffectively overscanned electron beams having a deflection angle that is a little larger than the maximum deflection angle will be incoming to the side end of the open portion, while the reflected electron beams (shown by the dotted lines in FIG. 1) are scanned onto the luminescent screen 12, thereby producing the halations.

The extensively used conventional method for preventing such a phenomenon is constituted such that, instead of the frame, the electron shield 15 is extended up to the inside of the open portion of the frame 14, thereby limiting the outer boundary of the effective region. In such a case, the leading end of the electron shield 15 having a thickness (usually 0.2 mm or less) far thinner than that of the frame 14, has a small reflection area, and therefore, it can effectively prevent halation. However, in order to limit the outer boundary of the effective region by means of the electron shield 15 having so thin a thickness, an extremely high degree of precision is required in its fabrication and assembly, as well as making the workability very fastidious, thereby making it difficult to expect a saving of manufacturing cost.

Under this circumstance, various techniques have been proposed, attempting to limit the outer boundary of the effective region by means of a shadow mask frame, and to modify the shape of the leading end of the open portion of the frame, in order to prevent halations. However, almost all of them were of the technical constitution such that the reflection area for the ineffective electron beams at the side end of the open portion of the frame is to be reduced.

For example, one of these techniques is disclosed in Japanese Patent Publication No. 58-9539, and is illustrated in FIG. 2. This technique is constituted such that, in the ordinary shadow mask type color picture tube described above referring to FIG. 1, the edge of the open portion of the frame 14' of the shadow mask 13 is bent toward the electron gun which is the electron beam source, and the leading end of the bent portion is provided with a sharp burr 19 in order to minimize the reflection area for the ineffective electron beams.

However, the method of providing the burr 19 to the leading end of the open portion of the frame 14' is constituted such that the burrs are produced between a punch and die when carrying out the blanking process, and therefore, the shapes of the burrs are not uniform, with the result that not only the halation prevention effect is not sufficient, but also there are many problems in handling the component because the burr forms a sharp edge.

SUMMARY OF THE INVENTION

The present invention is intended to overcome the disadvantages of the conventional techniques.

Therefore, it is the object of the present invention to provide a shadow mask frame for prevention of halation, in which the halation prevention effect is superior, and it is convenient to manufacture, assemble and handle.

To accomplish the above object, the device of the present invention is constituted such that, instead of minimizing the reflection area of the ineffective electron beams as in the conventional techniques, the reflection direction of the ineffective electron beams are positively controlled by providing a reflecting face near the outer boundary of the effective region.

The electron beam does exactly conform to the reflection law that the incident and outgoing angles for the light ray are the same as each other; but movements similar to it can be observable in the electron beam. For example, if the reflecting face is disposed substantially perpendicularly to the direction of the incident ineffective electron beams, then the ineffective electron beams will be reflected in a direction almost the same as the incident direction. Accordingly, the incident angle of the ineffective electron beams near the effective region, which causes halation due to the reflections from a plane crossing perpendicularly the axis of the picture tube, can be positively controlled.

That is, if the reflecting face is disposed such that it should have a slope that is the same as the maximum deflection angle or substantially the same as that, the incoming ineffective electron beams will be reflected along a path substantially the same as the incoming path, and therefore, the problem that halation is produced upon mislanding of the beams on the luminescent screen is overcome. (Here, if observed from the axial direction, the electron beams are deflected toward the outer side of the picture tube through a deflecting element, and therefore, it is expected that the reflecting path will be formed slightly to the outer side relative to the incoming path.)

The shadow mask frame for prevention of halation according to the present invention based on the principle as described above is constituted as follows. The shadow mask frame supporting a shadow mask to be maintained by a certain gap to the luminescent screen formed on the inner surface of a panel, and having an open portion for limiting the outer boundary of the effective region for the electron beams, characterized in that a bent end portion is provided around the periphery of the open portion of the said frame in a predetermined inclination angle relative to the plane of the frame, the bending being formed toward the panel.

BRIEF DESCRIPTION OF THE DRAWINGS

The above object and other advantages of the present invention will become more apparent by describing the preferred embodiment of the present invention with reference to the attached drawings in which.

DESCRIPTION OF THE PREFERRED EMBODIMENT

Figure 1:
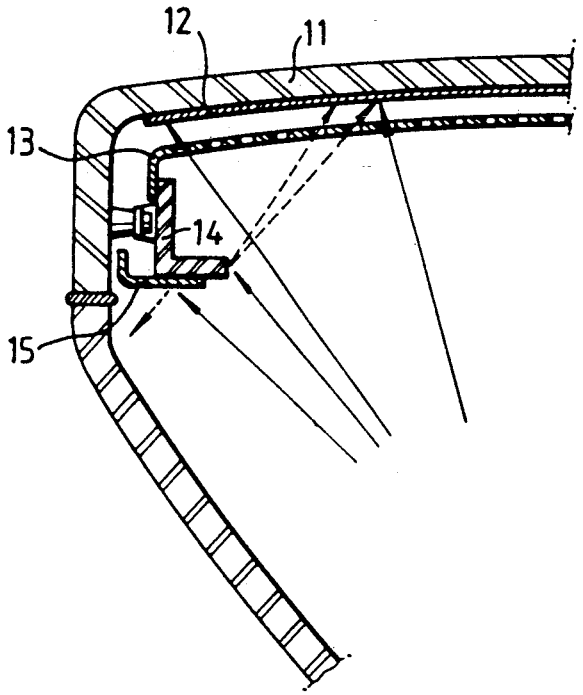
FIG. 1 (Prior Art)
FIG. 1 is a fragmentary sectional view of the conventional shadow mask type color picture tube.
Figure 2:
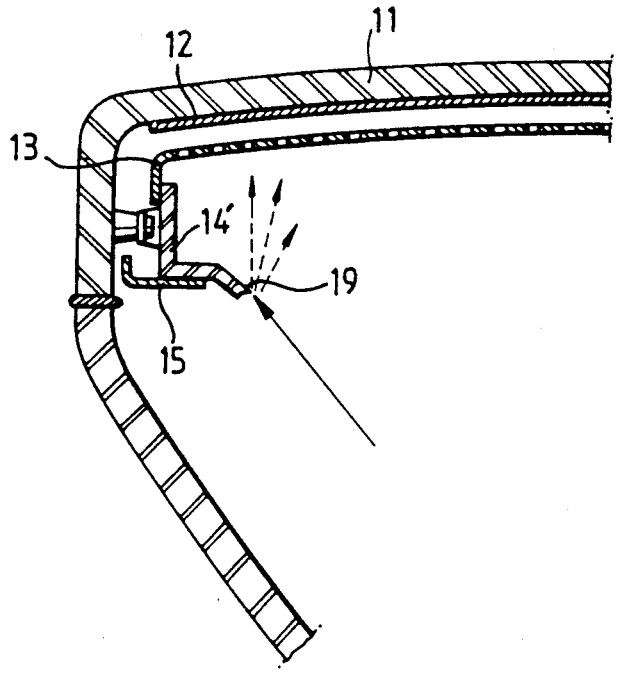
FIG. 2 (Prior Art)
FIG. 2 is a fragmentary sectional view of a conventional color picture tube in which the shadow mask is provided with the conventional halation prevention element.
Figure 3:
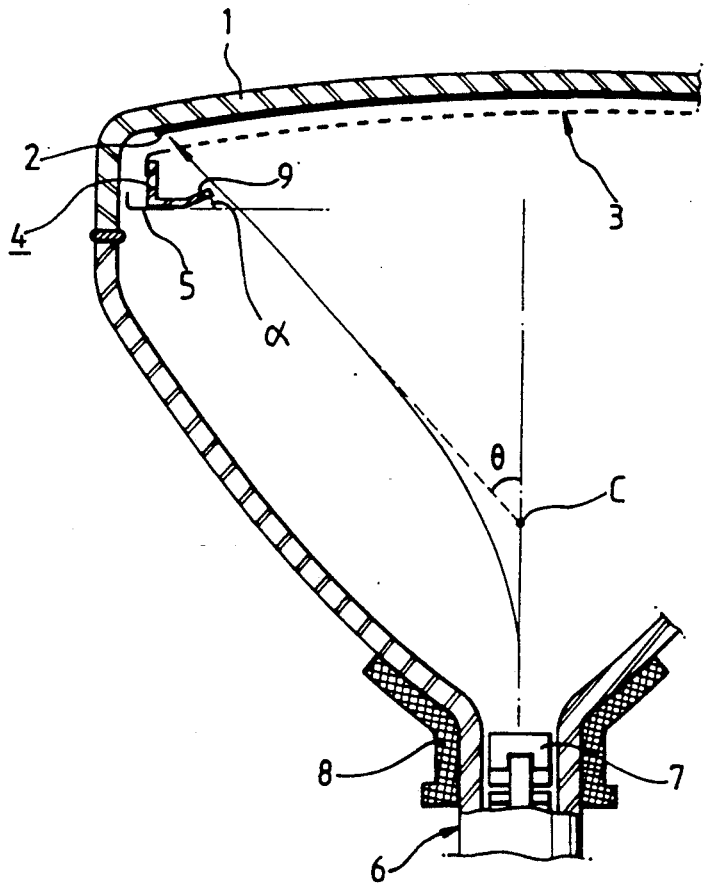
FIG. 3 is a schematic sectional view of the color picture tube according to the present invention.

FIG. 3 is a schematical sectional view of the shadow mask type color picture tube provided with a shadow mask frame according to the present invention. This color picture tube is constituted such that a luminescent screen 2 formed by depositing the R,G,B phosphors in the form of dots or stripes is provided on the inner surface of the face plate of a spherical glass panel 1; an electron gun 7 for emitting electron beams (indicated by the solid arrow in the drawing) is installed at the neck 6 of the picture tube; and a deflecting elements 8 such as a deflecting coils, is installed around the neck 6 for deflecting the electron beams so as for the electron beams to be guided to the effective region of the luminescent screen 2.

At a position separated from the luminescent screen 2 by a certain distance, a frame 4 supports a shadow mask 3 made of a thin metal sheet, which is provided with numerous apertures for selectively guiding the electron beams emitted from the electron gun 7 to the respective luminescent dots or stripes formed on the luminescent screen 2. An electron shield 5 is installed between the frame 4 and the skirt of the panel 1 so as for the shield 5 to shield the space between the frame 4 and the skirt of the panel 1.

According to the unique feature of the present invention, the frame 4 of the shadow mask 3 is bent in a predetermined inclination angle $\alpha$ toward the frontal face of the panel 1 at the edge of the open portion, thereby forming a bent end portion 9. The side face of this bent end portion 9 facing the electron gun serves as a reflecting face for the ineffectively overscanned electron beams.

The inclination angle $\alpha$ of the bent end portion 9 is determined as follows.

The electron beams emitted from the electron gun 7 are scanned to the effective region of the luminescent screen 2 after changing their advancing direction through the deflecting element 8. The intersecting point between the extended axis of the electron gun 7 and the advancing direction of the electron beam after being deflected is the deflection center C, and the angle formed by the above mentioned two extended lines at the deflection center C is the deflection angle. The deflection angle formed by the electron beam passing through the outermost boundary of the effective region is called the maximum deflection angle $\theta$.

In a color picture tube provided with an electron gun assembly consisting of three R,G,B electron guns, the deflection centers C and the maximum deflection angles are separately formed for the respective electron guns. However, in approximate terms, even if the deflection center and the maximum deflection angle for the centrally located electron gun are used as the typical values, no faulty results will be given in practical terms, and therefore, the descriptions below will be made based on this assumption.

The incident angle of the ineffective electron beams which cause halation upon being reflected at the side end of the open portion of the frame 4 can be thought to be slightly larger than the maximum deflection angle $\theta$ described above, and therefore, if the incident angle of the problematic ineffective electron beam is assumed to be equivalent to the maximum deflection angle $\theta$ in an approximate term, then the bent end portion 9 of the frame 4 perpendicularly crossing thereto and constituting a reflecting face can be seen to have an inclination angle $\alpha$ as large as the maximum deflection angle $\theta$ geometrically relative to the plane of the bent end portion 9 of the frame 4.

The bent end portion 9 is bent toward the panel 1, and its inclination angle $\alpha$ should be desirably either the same as or slightly smaller than the above mentioned maximum deflection angle $\theta$.

Figure 4:
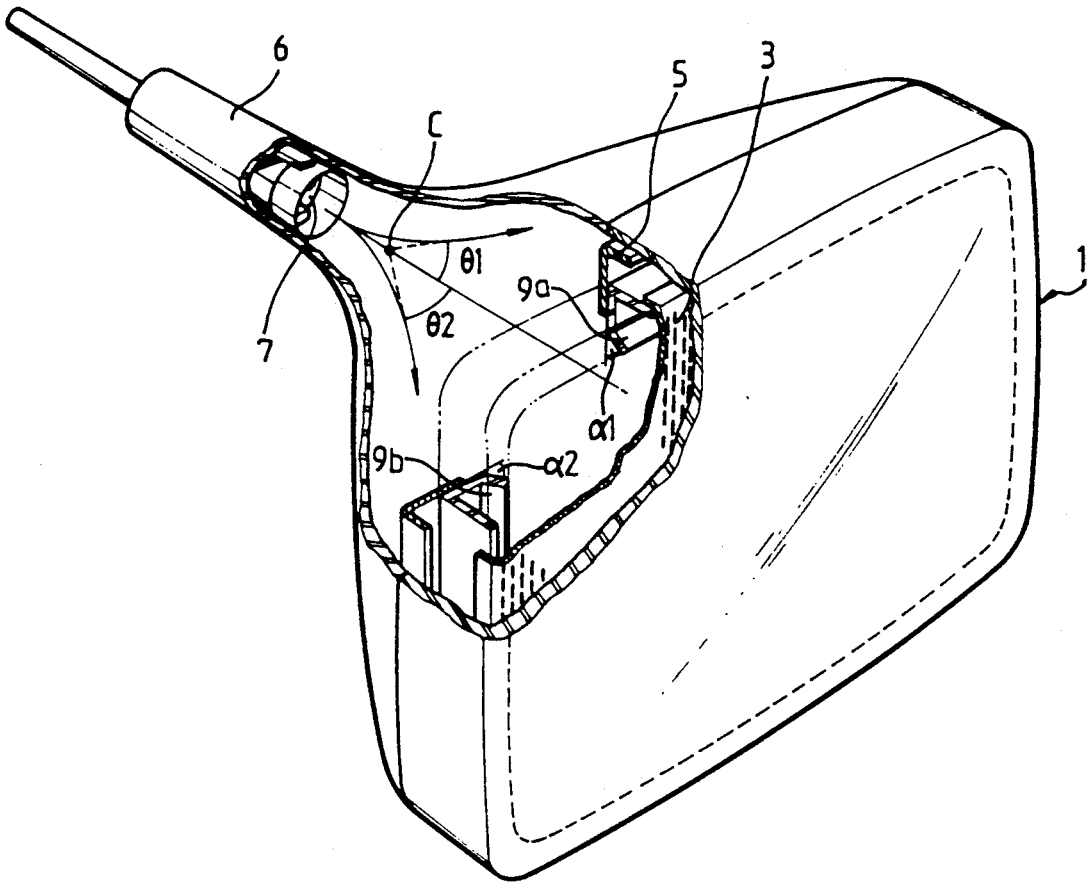
FIG. 4 is a partly cut-out perspective view of the color picture tube of FIG. 3.

Particularly as shown in FIG. 4, the maximum deflection angle $\theta_1$ for the direction of the longer side of the panel 1 and the maximum deflection angle $\theta_2$ for the direction from of the shorter side of the panel 1 are different each other, and therefore, in the frame 4 also, the inclination angle $\alpha_1$ of the bent end portion 9*a* extended in the direction of the longer side is preferably close to the value of the maximum deflection angle $\theta_1$ for the direction of the longer side, while the inclination angle $\alpha_2$ of the bent end portion 9*b* extended in the direction of the shorter side is preferably close to the value of the maximum deflection angle $\theta_2$ for the direction of the shorter side. In exact terms, the deflection centers for the directions of the longer and shorter sides are different from each other, but the drawing shows that they are the same as the deflection center C in an approximate term.

Further, depending upon the requirement, the average value of the maximum deflection angles $\theta_1$, $\theta_2$ for the directions of the longer and shorter sides can be taken as the overall inclination angle $\alpha$ of the whole bent end portion 9 around the periphery of the open portion of the frame 4.

Figure 5:
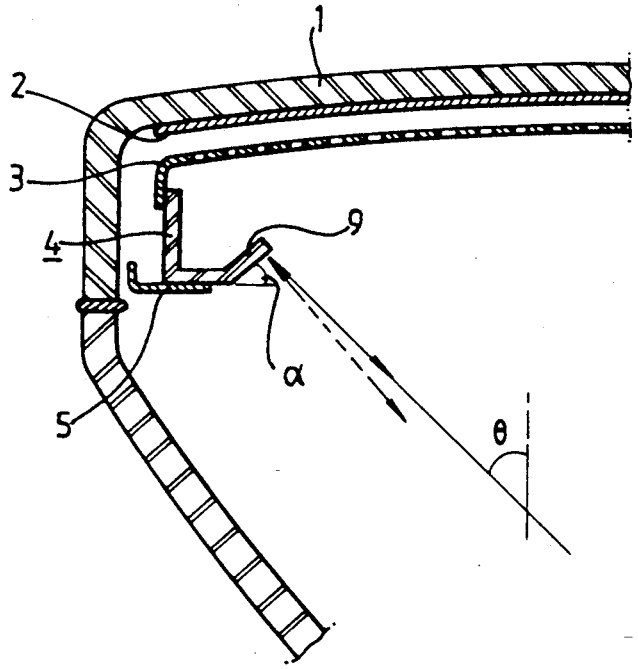
FIG. 5 is a sectional view of the critical portion of the vicinity of the color picture tube panel for showing the operation of the device of the present invention.

The shadow mask frame according to the present invention constituted as above will now be described as to its functions referring to FIG. 5. The ineffective electron beams (indicated with the arrow of solid lines in the drawing) incoming with an incident angle approximately close to the maximum deflection angle $\theta$ are reflected from the bent end portion 9 of the frame 4, which perpendicularly crosses the incoming path of the beams, and then the reflected beams advance along a reflection path (indicated with the arrow of dotted lines in the drawing) approximately same as the incoming path toward the opposite side of the panel 1. The ineffectively overscanned electron beams thus reflected collide with the side wall of the funnel near the neck 6, and then, are dissipated by being grounded through an inner graphite layer coated on the inner face thereof.

Accordingly, the ineffective electron beams are prevented from advancing farther toward the panel 1, so that they can not produce undesirable visible light emitted on the luminescent screen 2, i.e., halation. Therefore, the luminance and the purity of the image are protected from deterioration, thereby producing clear images.

According to the present invention as described above, the ineffective electron beams are positively reflected away toward the opposite side of the luminescent screen, with the result that not only the halation prevention effect becomes superior, but also there is no difficulty in manufacturing and assembling. Therefore, productivity is improved, and clear images can be economically obtained from the color picture tube of the present invention.

What is claimed is:

1. A shadow mask frame for prevention of halation in shadow mask type color picture tube having the shadow mask frame supporting a shadow mask to be maintained at a certain gap from a luminescent screen formed on the inner surface of a panel illuminated by electron beams, and having an open portion for limiting the outer boundary of the effective region for the electron beams, comprising:

a bent end portion provided around the periphery of the said open portion of the frame in a predetermined inclination angle relative to the plane of the frame, the bent end portion being formed toward said panel, said inclination angle of said bent end portion being approximately the same as, or slightly smaller than, the maximum deflection angle of said electron beam.

2. The shadow mask frame for prevention of halation as claimed in claim 1, wherein the inclination angle of said bent end portion extending in the direction of a longer side of said shadow mask frame and the inclination angle of said bent end portion extending in the direction of a shorter side of said shadow mask frame are respectively determined to be approximately the same as, or slightly smaller than, the maximum deflection angle for the direction of the longer side and the maximum deflection angle for the direction of the shorter side.

3. The shadow mask frame for prevention of halation as claimed in claim 1, wherein the inclination angle of said bent end portion is determined to be approximately the same as, or slightly smaller than, the average value of the maximum deflection angle of said electron beams in the direction of the longer side of said shadow mask frame and the maximum deflection angle in the direction of the shorter side of said shadow mask frame.

4. The shadow mask frame of claim 1, further comprised of:

said bent end portion having first surfaces disposable to extend toward first sides of said panel and second surfaces disposable to extend toward second sides of said panel;

said first surfaces forming said inclination angle to be close to or less than a greatest deflection angle occurring between an extended axis of the electron beams originating from a central location within a neck of the picture tube and a direction of advance of the electron beams after maximum deflection toward said first sides and away from said extended axis; and said second surfaces forming said inclination angle to be close to or less than a greatest deflection angle occurring between said extended axis and a direction of advance of the electron beams after maximum deflection towards said second sides and away from said extended axis.

5. A shadow mask frame, comprising:

a first side having a periphery positionable within and spaced apart from longer and shorter sides of a face plate of a cathode ray tube;

a second side extending substantially coextensively with and transversely to said first side; and a reflecting face extending substantially coextensively with said second side, extending toward said face plate to define an interior opening enabling passage of electron beams travelling from a neck of the cathode ray tube to the face plate, said reflecting face defining an angle of inclination with respect to an extended axis of the electron beams originating from a central location within the neck, with said angle of inclination being equal to or less than a maximum angle of deflection occurring between said extended axis and a direction of advance of the electron beams after maximum deflection away from said extended axis.

6. The shadow mask frame of claim 5, further comprised of said first side being substantially parallel to said extended axis.

7. The shadow mask frame of claim 5, further comprised of said second side being substantially perpendicular to said extended axis.

8. The shadow mask frame of claim 6, further comprised of said second side being substantially perpendicular to said extended axis.

9. The shadow mask frame of claim 5, further comprised of:

said reflecting face having first surfaces disposable to extend toward said shorter sides and second surfaces disposable to extend toward said longer sides, said first surfaces forming said angle of inclination close to or less than a greatest angle of deflection occurring between said extended axis and a direction of advance of the electron beams after maximum deflection toward said shorter sides and away from said extended axis; and said second surfaces forming said angle of inclination close to or less than a greatest angle of deflection occurring between said extended axis and a direction of advance of the electron beams after maximum deflection toward said longer sides and away from said extended axis.

10. The shadow mask of claim 5, further comprised of said reflecting surface being joined to said first side by said second side.

11. The shadow mask frame of claim 10, further comprised of:

said reflecting face having first surfaces disposable to extend toward said shorter sides and second surfaces disposable to extend toward said longer sides, said first surfaces forming said angle of inclination close to or less than a greatest angle of deflection occurring between said extended axis and a direction of advance of the electron beams after maximum deflection toward said shorter sides and away from said extended axis; and said second surfaces forming said angle of inclination close to or less than a greatest angle of deflection occurring between said extended axis and a direction of advance of the electron beams after maximum deflection toward said longer sides and away from said extended axis.

12. The shadow mask frame of claim 6, further comprised of:

said reflecting face having first surfaces disposable to extend toward said shorter sides, and second surfaces disposable to extend toward said longer sides, said first surfaces forming said angle of inclination close to or less than a greatest angle of deflection occurring between said extended axis and a direction of advance of the electron beams after maximum deflection toward said shorter sides and away from said extended axis; and said second surfaces forming said angle of inclination close to or less than a greatest angle of deflection occurring between said extended axis and a direction of advance of the electron beams after maximum deflection toward said longer sides and away from said extended axis.

13. The shadow mask of claim 5, further comprised of the angle of inclination being approximately equal to or less than, an average value of the maximum deflection angle of the electron beams in a direction toward said longer side and the maximum deflection angle of the electron beams in a direction toward said shorter side.

14. The shadow mask of claim 6, further comprised of the angle of inclination being approximately equal to or less than, an average value of the maximum deflection angle of the electron beams in a direction toward said longer side and the maximum deflection angle of the electron beams in a direction toward said shorter side.

15. The shadow mask of claim 7, further comprised of the angle of inclination being approximately equal to or less than, an average value of the maximum deflection angle of the electron beams in a direction toward said longer side and the maximum deflection angle of the electron beams in a direction toward said shorter side.

16. The shadow mask of claim 8, further comprised of the angle of inclination being approximately equal to or less than, an average value of the maximum deflection angle of the electron beams in a direction toward said longer side and the maximum deflection angle of the electron beams in a direction toward said shorter side.

17. A cathode ray tube, comprising:

a face plate;

a luminescent screen disposed upon the interior of said face plate;

an electron source positioned spaced apart from said luminescent screen, with beams of electrons emanating from said electron source defining an extended axis through a central portion of said luminescent screen;

a shadow mask interposed between said luminescent screen and said electron source;

means for supporting said shadow mask in spaced-apart disposition from said luminescent screen, said supporting means comprising:

a first side having a periphery positionable within and spaced apart from longer and shorter sides of said face plate;

a second side extending substantially coextensively with and transversely to said first side; and a reflecting face extending substantially coextensively with said second side to define an interior opening enabling passage of said electron beams travelling from said source to the face plate, said reflecting face defining an angle of inclination with respect to an extended axis of the electron beams originating from a central location within the neck, with said angle of inclination being equal to or less than a maximum angle of deflection occurring between said extended axis and a direction of advance of the electron beams after maximum deflection away from said extended axis.

18. The cathode ray tube of claim 17, further comprised of:

said reflecting face having first surfaces disposable to extend toward said shorter sides and second surfaces disposable to extend toward said longer sides, said first surfaces forming said angle of inclination close to or less than a greatest angle of deflection occurring between said extended axis and a direction of advance of the electron beams after maximum deflection toward said shorter sides and away from said extended axis; and said second surfaces forming said angle of inclination close to or less than a greatest angle of deflection occurring between said extended axis and a direction of advance of the electron beams after maximum deflection toward said longer sides and away from said extended axis.

19. The cathode ray tube of claim 17, further comprised of the angle of inclination being approximately equal to or less than, an average value of the maximum deflection angle of the electron beams in a direction toward said longer side and the maximum deflection angle of the electron beams in a direction toward said shorter side.

20. The shadow mask of claim 5, further comprised of said reflecting face defining a surface substantially perpendicular to a path of travel of said electron beams subjected to said maximum angle of deflection.

* * * * *

UNITED STATES PATENT AND TRADEMARK OFFICE

CERTIFICATE OF CORRECTION

PATENT NO. : 5,298,832
DATED : March 29, 1994
INVENTOR(S) : Byeong-gak Jeong; Keun-bae Lee It is certified that error appears in the above-indentified patent and that said Letters Patent is hereby corrected as shown below:

Title page,
Item: [75], Change " Byeong G. Jeong; Keun B. Lee" to --Byeong-gak Jeong; Keon-bae Lee-- .

| | | |
|---|---|---|
| Column 1, | Line 33, | After "that", Delete "a" ; |
| Column 4, | Line 53, | After "direction", Delete "from" ; |
| | Line 54, | After "different", Insert --from-- . |

Signed and Sealed this

Eleventh Day of October, 1994

*Attest:*

Bruce Lehman

BRUCE LEHMAN

*Attesting Officer*

*Commissioner of Patents and Trademarks*